United States Patent [19]

Tada

[11] Patent Number: 4,942,431

[45] Date of Patent: Jul. 17, 1990

[54] IMAGE FORMING APPARATUS

[75] Inventor: Tatsuya Tada, Kawasaki, Japan

[73] Assignee: Canon Kabushiki Kaisha, Tokyo, Japan

[21] Appl. No.: 398,444

[22] Filed: Aug. 25, 1989

[30] Foreign Application Priority Data

Aug. 31, 1988 [JP] Japan ..... 63-214803
Aug. 31, 1988 [JP] Japan ..... 63-214806

[51] Int. Cl.[5] ..... G03G 21/00
[52] U.S. Cl. ..... 355/246; 355/208
[58] Field of Search ..... 355/246, 208, 204, 245; 118/653, 657

[56] References Cited

U.S. PATENT DOCUMENTS 4,341,461 7/1982 Fantozzi ..... 355/246
4,607,933 8/1986 Haneda et al. ..... 355/246
4,639,117 1/1987 Murai et al. ..... 355/246
4,785,331 12/1988 Oka et al. ..... 355/246 X
4,847,659 7/1989 Resch, III ..... 355/208 X

*Primary Examiner*—A. T. Grimley

*Assistant Examiner*—Sandra L. Hoffman

*Attorney, Agent, or Firm*—Fitzpatrick Cella Harper & Scinto

[57] ABSTRACT

An image forming apparatus includes an image bearing member; a latent image forming device for forming a latent image on the image bearing member; a developing device for developing the latent image, including, a developer container for containing a developer including carrier and toner particles, a toner container for containing the toner particles, a toner supply device for supplying the toner particles from the toner container to the developer container, a developer carrying member for carrying on its surface the developer supplied from the developer container, a sensor for detecting a toner content in the developer; a control device for controlling the toner supply from the toner container to the developer container on the basis of an output of the sensor, wherein when a toner supply signal is not produced within a predetermined period of time, a predetermined latent image is formed on the image bearing member, and the predetermined latent image is developed by the developing device.

12 Claims, 11 Drawing Sheets

IMAGE FORMING APPARATUS

FIELD OF THE INVENTION AND RELATED ART

The present invention relates to an image forming apparatus of an electrophotographic type or an electrostatic recording type wherein an electrostatic latent image is formed and is developed with a developer containing toner and carrier particles.

A two component developer containing toner particles and carrier particles is widely used in an image forming apparatus wherein a latent image formed on an image bearing member surface is developed with the toner into a visualized image.

Such a developing apparatus using the two component developer is equipped with a developer container provided with a developer stirring member. The stirring member serves to uniformly disperse the newly supplied toner particles in the already existing developer particles in the container, and in addition, to triboelectrically charge the toner particles by the rubbing with the carrier particles to a polarity proper to develop the latent image.

In an image forming apparatus using the two component developer, only the toner is consumed for developing the image, but hardly any carrier particles are consumed. Therefore, with continuance of the developing operations, the content of the toner in the developer decreases with the result of reduction of the image density. Therefore, it is required to detect the toner content (percentage of the amount of the toner in the developer) and to supply the toner when the toner content decreases.

As for the toner content detecting means, there are optical means for detecting change in the light reflection index of the developer due to the change of the toner content in the developer, magnetic means for detecting change in the magnetic permeability and others.

In the conventional image forming apparatus, the stirring means is to circulate the developer, and therefore, it is operated continuously or intermittently during continuance of the developing operation, irrespective of toner supply.

Therefore, the amount of the charge of the toner gradually increases proportionally to the integrated period of stirring. When, for example, originals having very small image ration (whitish originals, for example) are continuously copied, only a small amount of the toner is consumed, with the result that the stirring operation is carried out without supply of the new toner. Therefore, the developer is stirred too much, so that the amount of toner becomes very large (toner charge-up). When this occurs, the image density reduces, because the excessively charged toner are strongly attached to the developer carrying member or to the carrier particles by the electrostatic force, and therefore, the toner particles are not easily deposited on the latent image.

SUMMARY OF THE INVENTION

Accordingly, it is a principal object of the present invention to provide an image forming apparatus wherein even if the apparatus is continued to be operated with low consumption of the toner particles, the sufficient image density can be maintained.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
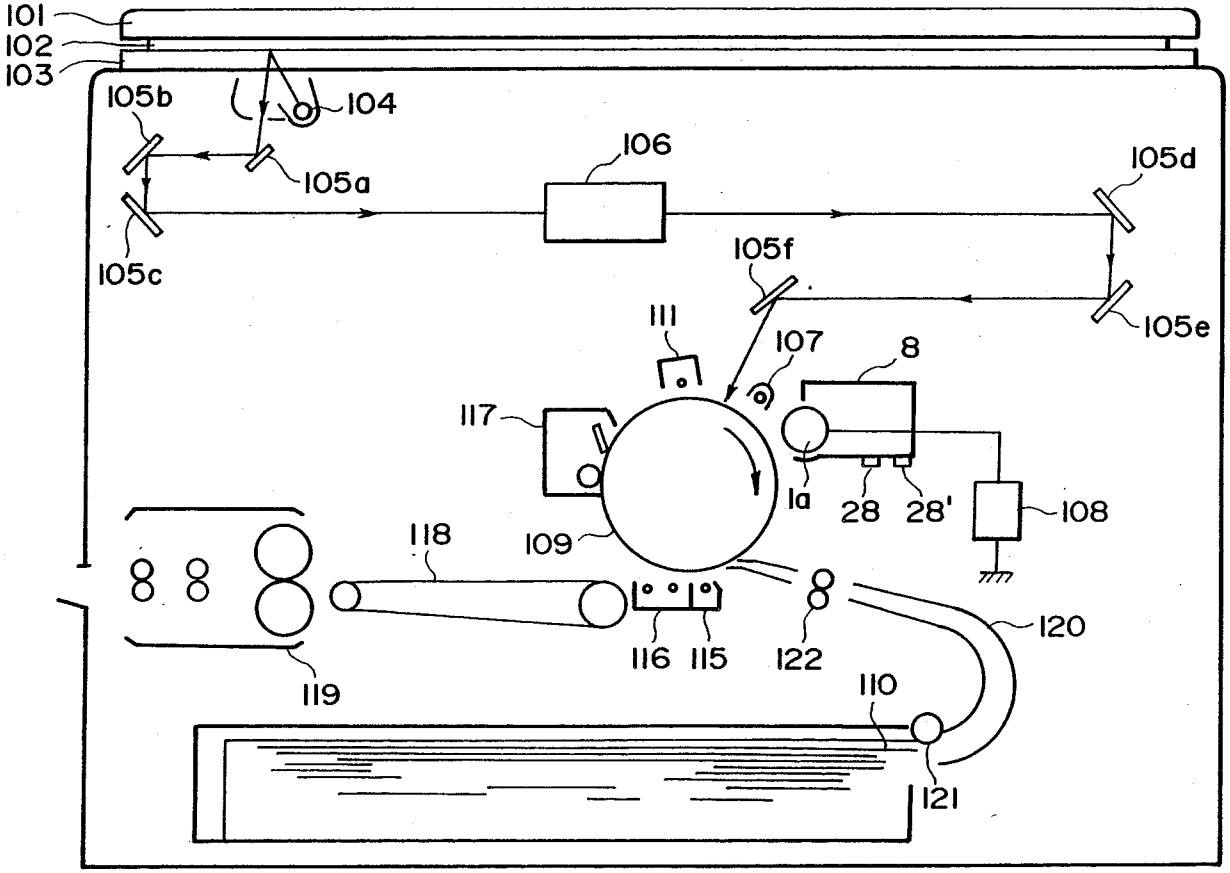
FIG. 1 is a sectional view of an electrophotographic copying machine to which the present invention is applicable.

Referring to FIG. 1, there is shown an image forming apparatus to which the present invention is applicable. In this Figure, an original 102 to be copied is placed on an original supporting platen 103 and is stressed by a cover 101. A light image of the original 102 is projection through an optical system onto an electrophotographic photosensitive member 109 in the form of a drum rotating in the direction indicated by an arrow. The optical system effective to scan the original comprises an original illuminating lamp 104 movable in parallel with the platen 103, mirror 105*a*, 105*b* and 105*c*, a lens 106 and fixed mirrors 105*d*, 105*e* and 105*f*. The photosensitive member 109 is uniformly charged by a charger 111 before it is exposed to the image light. By the exposure to the image light, an electrostatic latent image is formed on the photosensitive member. During the period in which the charger 111 is operating, but the optical system is not operating so that no image is projected onto the photosensitive member 109, a lamp 107 is on so as to electrically discharge the photosensitive member 109 to provide on the photosensitive member such a potential has not to deposit the toner to the photosensitive member 109.

The electrostatic latent image is developed in a developing station by a developing device 8 which will be described hereinafter. In order to prevent what is called "fog", and in order to provide sufficient image density, a developer carrying sleeve 1*a* which will be described hereinafter in detail is supplied with a developing bias voltage from a voltage source 108.

The toner image provided by the development is transferred by a transfer charger 115 onto a transfer sheet 110 fed by a guide 120, feeding rollers 121 and 122.

The transfer sheet 110 is electrically discharged by a separation discharger 116 from the photosensitive member 109, and is conveyed by a belt 118 to an image fixing device 119 where the toner image on the transfer sheet is fixed. Finally, the transfer sheet is discharged to outside of the image forming apparatus. On the other hand, the residual toner remaining on the photosensitive member surface after the image transfer is removed therefrom by a cleaning device 117.

Figure 2A:
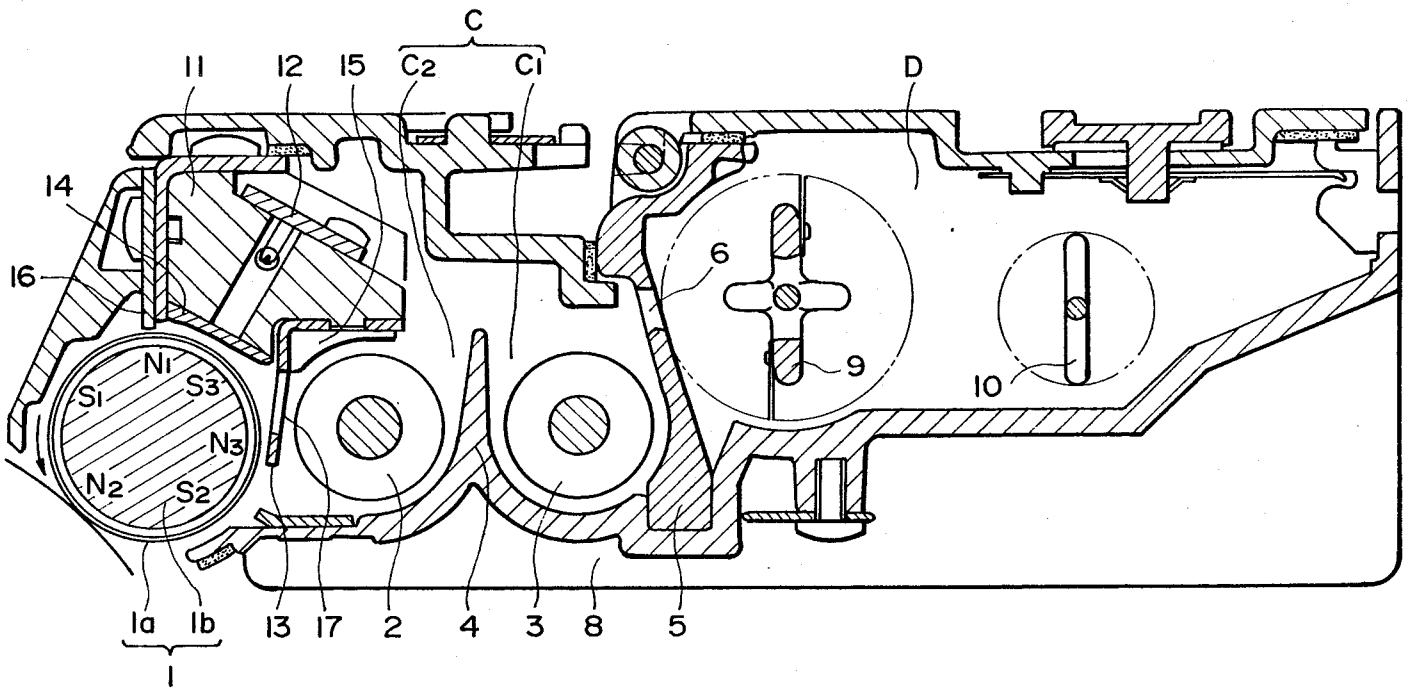
FIG. 2A is a sectional view of a developing apparatus usable in the present invention.
Figure 2B:
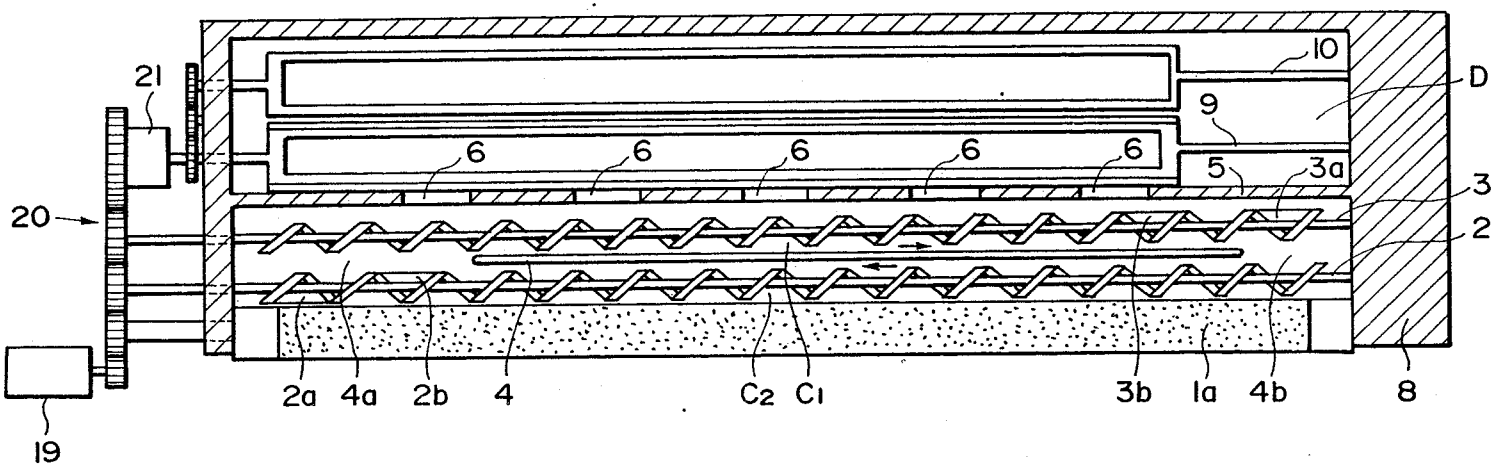
FIG. 2B is a horizontal sectional view of the developing apparatus of FIG. 2.

Referring to FIGS. 2A and 2B, there is shown a developing apparatus applicable to the present invention. The developing device is provided with a developer container 8. The inside of the container 8 is divided by a partition wall 5 into a toner accommodating chamber D and a developer container C for containing a two component developer having toner particles and carrier particles (magnetic particles). In this Figure, the toner contained in the toner chamber D and the developer in the developer chamber C are omitted for clearly showing the structure. The developer chamber C is further divided by a partition wall 4 into a developer stirring portion C1 and a developer supplying portion C2 for supplying the developer to the developer carrying member 1. The toner contained in the toner chamber D is supplied into the developer chamber C through a toner supply ports 6 formed in the partition wall 5, when toner supplying members 9 and 10 (supplying means) are rotated.

The toner particles supplied through the most downstream supply port 6 (FIG. 2B) with respect to the toner conveyance direction by the developer stirring screw 3, start to be fed to the developing carrying member 1 in several seconds. Therefore, the supplied toner is preferably already stirred and mixed with the existing developer, when the new toner reaches the developer carrying member 1.

In order to accomplish this, fins **3*b*, as shown in FIG. 2B, are mounted on the screw 3 at a position between the most downstream toner supply inlet 6 and an opening 4*b* functioning as a developer supplied opening from the developer stirring portion C1 to the developer supplying portion C2 and to the developer carrying member 1**.

Accordingly, at the position of the fins **3*b*, the developer is temporarily stagnated by the turbulence caused by the fins 3*b*, and in the turbulence, the developer and the supplied toner are sufficiently stirred and mixed, and then we supplied to the opening 4*b***.

The developer carrying member 1 is disposed in the developer container C and is provided with a developing sleeve **1*a* of non-magnetic material, the developing sleeve 1*a* contains a magnet roll 1*b*. The magnet roll 1*b* is magnetized at the positions indicated by reference N1, N2, N3, S1, S2 and S3. Since the magnet roll 1*b* are fixed to a frame at the opposite ends, does not rotate. The outside of developing sleeve 1*a* is rotated in the direction of an arrow at a predetermined peripheral speed around the magnet roll 1*b***.

A rotational screw 2 and the rotational screw 3 are disposed substantially in parallel with the developing sleeve **1*a* to serve for stirring and conveying the developer. The directions of developer conveyance by the screws 2 and 3 are opposite. In this embodiment, the developer is conveyed in the direction indicated by arrows in FIG. 2B. The partition 4 in the developer container C is formed to provide end openings 4*a* and 4*b*, as shown in FIG. 2B. The developer conveyed by the screws 2 and 3 are transferred between the chambers C1 and C2 through the openings 4*a* and 4*b*. The screws 2 and 3 are provided with fins 2*a*, 2*b* and 3*a*** at the positions indicated so as to promote smooth and quick transfer of the developer.

In the developer chamber C of the developer container 8, there is disposed developer circulation limiting members 11 and 15 for defining the circulation region of the developer on the peripheral surface of the developing sleeve **1*a***.

A part of the developer on the peripheral surface of the sleeve **1*a* is scraped by a scraper member 13, and the rest is conveyed toward the developing region. The developer removed by the scraper 13 is conveyed and mixed with the developer fed by the developer conveying screw 2. A part of the developer conveyed by the conveying screw 2 is moved toward the developer carrying member through an opening 17 formed in the scraper member 13. The developer conveyed to the developing region with the rotation of the developing sleeve 1 is urged into a clearance formed between the peripheral surface of the developing sleeve 1*a* and a developer circulation limiting member 11, and therefore, the developer is quickly conveyed with high density. A doctor blade 16 functions to limit a height of a magnetic brush of the developer, and then further conveyed to the outside the developer container 8**.

A window 14 for toner content detection using a sensor 12 is disposed at a predetermined position substantially in the same plane as the surface of the developer circulation limiting member 11 faced to the developing sleeve **1*a*. Because the window of the sensor 12 is contactable to the developer, that is, the detecting surface 14 is disposed at such a position, the following advantages are provided: the developer can be quickly conveyed to the detecting surface 14; the developer has been sufficiently stirred and mixed at the detecting surface 14; and the amount of the developer and the uniformity of the density required for the good detection are assured at the detecting surface 14**.

Particularly, the detecting surface 14 of the sensor 12 is substantially on the same plane as the surface of the developer circulation limiting member 11 faced to the sleeve **1*a*, and therefore, the flow of the developer is the same in the detecting zone and outside the detecting zone. By this, the possible drawbacks arising when the sensor 12 is disposed close to the developing sleeve 1*a*** can be avoided.

Figure 3:
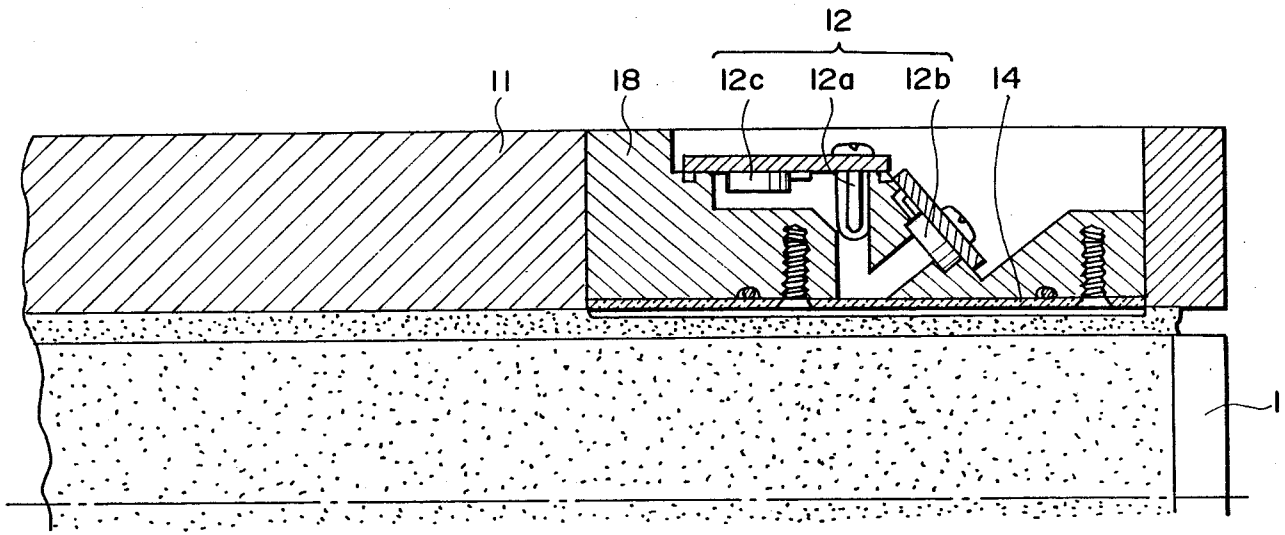
FIG. 3 is a sectional view of a toner content detecting sensor.

Referring to FIG. 3, there is shown an enlarged sectional view illustrating the toner content sensor 12. The sensor is comprised of a lamp (illuminating means) for detecting content of the toner in the developer, a photoelectric transducer element **12*b* for receiving an amount of light reflected by the developer illuminated by the lamp 12*a*, the amount of light corresponding to the toner content, and a photoelectric transducer element for detecting an amount of light directly coming from the lamp 12. Those elements are substantially enclosed by a housing 18 made of non-transparent material. As described hereinbefore, a detecting window 14 is made of transparent material and is disposed substantially in the same plane as such a surface of the developer circulation limiting member 11 as is faced to the developing sleeve 1*a*. The photoelectric transducer elements 12*b* and 12*c*** produce signals corresponding to the amounts of light received thereby.

The output signal of the transducer element **12*c*** is used as a reference signal.

Referring back to FIG. 2B, the sleeve 1*a*, screws 2 and 3, the toner conveying members 9 and 10 are driven by a motor 19 through a gear train 20. The gear train 20 includes a clutch 21 which, when energized, transmits the driving force from the motor 19 to the conveying members 9 and 10. In other words, when the toner is to be supplied from the chamber D to the chamber C, the clutch 21 is actuated. At this time, the screws 2 and 3 and the sleeve 1*a* are rotated together with the members 9 and 10. When the toner is not to be supplied from the chamber C to the chamber C, the clutch 21 is not energized. At this time, the members 9 and 10 are not rotated, but the screws 2 and 3 and the sleeve 1*a* are rotatable.

Figure 4:
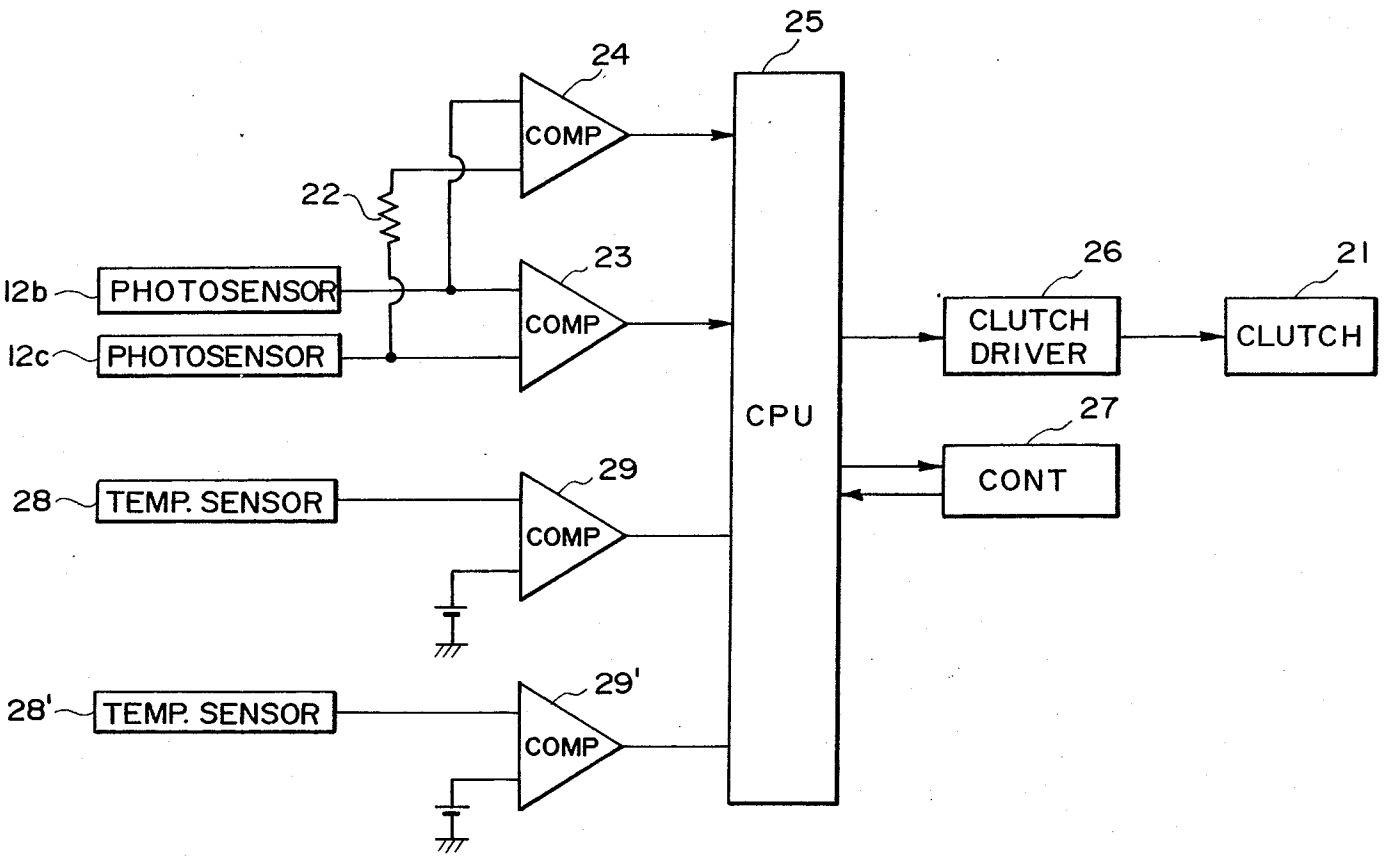
FIG. 4 is a diagram showing a control circuit.

Referring to FIG. 4, the signal from the photoelectric transducer element 12*b*, that is, a toner content signal (Vb) corresponding to the toner content (Tb) of the developer is supplied to a comparator circuit 24 and 24. The voltage Vb of the density signal is higher if the density is higher.

To one 23 of the comparator circuits, the output signal from the photoelectric transducer element 12*c* (Vc) is applied with a first reference signal. To the other 24 of the comparator circuit, a signal having a voltage level of Vc1 is applied as a second reference signal. The voltage Vc1 is lower than the voltage Vc, and therefore, the toner content T01 corresponding to the voltage Vc is lower than a target toner content T0, that is, the toner content corresponding to the voltage Vc. The second reference signal Vc1 can be easily obtained from the signal from the transducer 12*c* through a load such as resistance or the like. The target toner content is the toner content at which the toner content control is aimed. Generally, the toner content corresponds to an initial toner content, that is, the toner content of the new developer supplied into the developing device at the time when the developer is first used. When the detected toner content is higher than the toner content, the toner supply to the developer chamber C is stopped, whereas when it is lower than the target density, the toner is supplied into the developer chamber C.

The comparator 23 produces a signal of level 1 when the voltage Vb indicative of the detected toner content is equal to or higher than the first reference signal voltage Vc, whereas it produces a signal of level 0 when the detection voltage Vb is lower than the first reference signal voltage Vc. The comparator 24 produces a signal of level 1 when the toner content detection voltage is equal to or higher than the second reference signal voltage Vc1, whereas it produces a signal of level 0, when the content detection voltage Vb is lower than the second reference signal Vc1. A central processing unit (CPU) 25 containing a microcomputer receives a signal from comparators 23 and 24, in response to which it discriminates the toner density, and controls the toner supply to the developer chamber C from the toner chamber D in accordance with the flow chart shown in FIG. 5.

More particularly when $Vb \geqq Vc$, that is, when the detected toner density Tb is within the first content region which is not less than Tc, the CPU 25 deenergizes a clutch driver 26 to disengage the clutch 21 to stop the rotation of the supply members 9 and 10, that is, to stop the toner supply from the chamber D to the chamber C.

Figure 6:
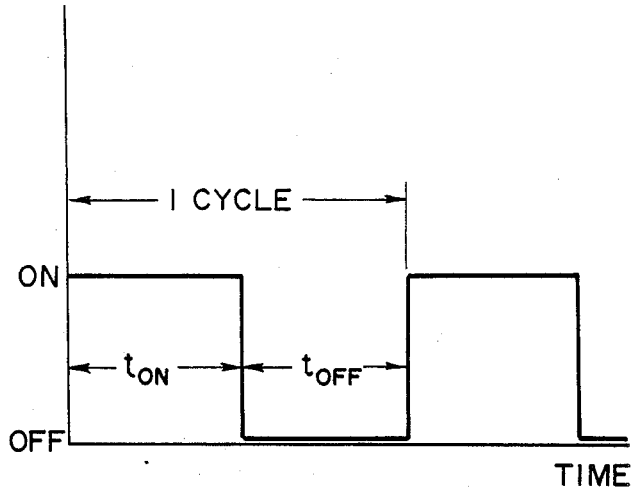
FIG. 6 is a graph illustrating toner supply operation.

When $Vc1 \leqq Vb < Vc$, that is, the detected toner content is within a second content region which is between Tc1 and Tc, the clutch driver 26 is energized, as shown in FIG. 6, to engage the clutch 21 periodically for a predetermined period of time without interrupting the image formation operation (copy operation) of the image forming apparatus, by which the supply members 9 and 10 are intermittently rotated so that the toner is intermittently supplied from the chamber D to the chamber C. In FIG. 6, the clutch is engaged at the time ton, and is disengaged at $t_{off}$. A toner supply operation is constituted by one cycle extending between the engagement and the disengagement, and the cycle is repeated until the toner content becomes equal to or higher than Tc.

When $Vb < Vc1$, the toner consumption speed is high due to, for example, high image portion ratio of originals. In order to meet this occasion and to reset the toner content to the first content region, the following operations are performed. When $Vb < Vc1$, that is, the toner content Tb is within the third content region which is lower than the content Tc1, the CPU 25 supplies a copy operation interrupting instruction signal (mode A) to the control circuit 27 containing the microcomputer for controlling the various operations described in conjunction with FIG. 1, and also it energize the clutch driver 26 shown in FIG. 6 to supply the toner from the chamber D to the chamber C. The control circuit 27 stops the operation of the optical system and also stops the image exposure of the photosensitive member 109. If the image forming apparatus is such that in the interruption mode A the photosensitive member 19 rotates with the charger 111 being operated, the control circuit 27 turns the discharging lamp 107 on to provide such a surface potential of the photosensitive member as not to receive the toner. During the copy interruption mode A for the supply of the toner, the rotation of the photosensitive member may be stopped, and the operation of the charger 111 may be stopped. In the copy interruption mode A for the supply of the toner, the developing bias voltage may be supplied or may not be supplied from the voltage source 108. However, the developing device driving motor 19 is not deenergized in order to stir the supplied toner with the existing developer to make the toner content uniform in the entirety of the developer.

In the interruption mode A from the supply of the toner, the image is not produced, and therefore, the toner consumption to the photosensitive member 109 is limited, by which the toner content is quickly reset to the first content region. When the toner content Tb equal to or higher than Tc is detected, the CPU 25 stops the toner supply, and supplies a copy operation resuming instruction signal to the control circuit 27, upon which the copy operation described above (image forming operation) is resumed.

Figure 7:
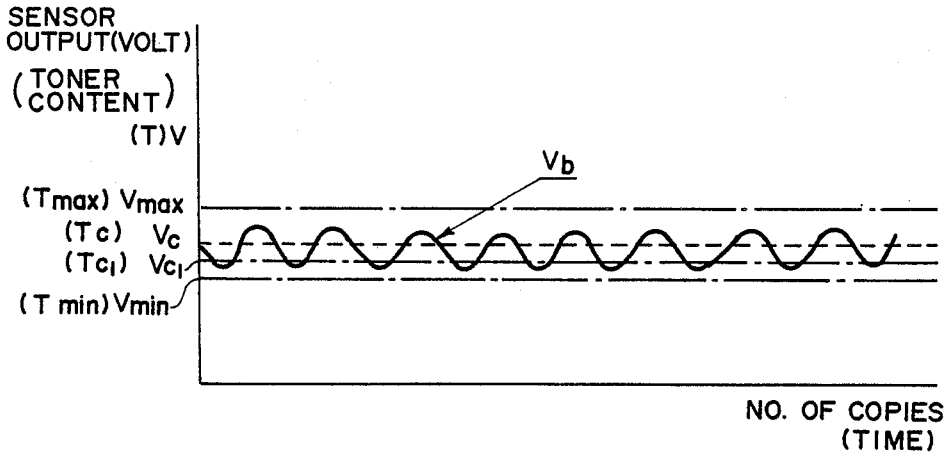
FIG. 7 is a graph showing a change of a toner content.

In this manner, the toner content can be controlled within a range between Tmin and Tmax, as shown in FIG. 7, even if whitish images are continuously copied.

The second reference signal voltage Vc1 is set preferably so as to be lower than the voltage Vc but higher than the voltage Vmin. In other words, it is preferable that the second reference signal voltage Vc1 is lower than the sensor output voltage corresponding to the target toner content Tc and is higher than the sensor output voltage Vmin corresponding to the lower limit toner content Tmin corresponding to the lower limit of the tolerable range of the image density. It is further preferable that the voltage Vc1 corresponding to such a toner content that the quantity of the toner consumed by deposition onto the photosensitive member is larger than the quantity of the toner supplied, but this is not inevitable. The voltage Vc is lower than the sensor output voltage Vmax which is produced when the toner content is Tmax which is the maximum limit of a tolerable range for limiting the fog.

Figure 8A:
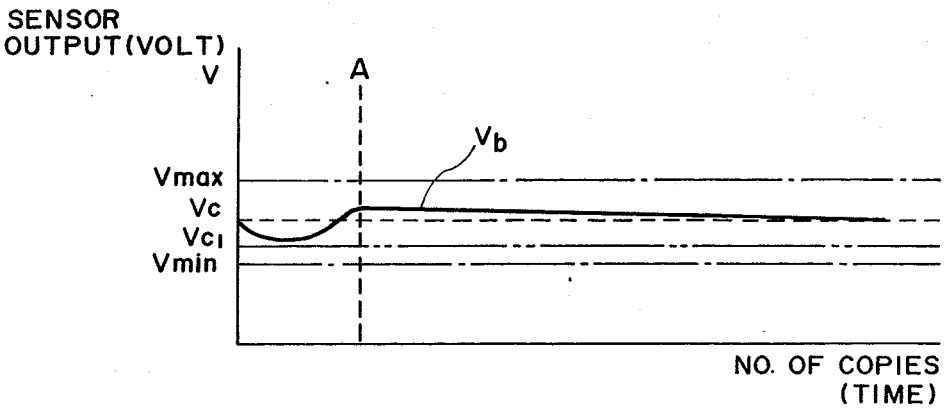
FIG. 8A is a graph showing a toner content change in the image formation process with small toner consumption in a conventional apparatus.
Figure 8B:
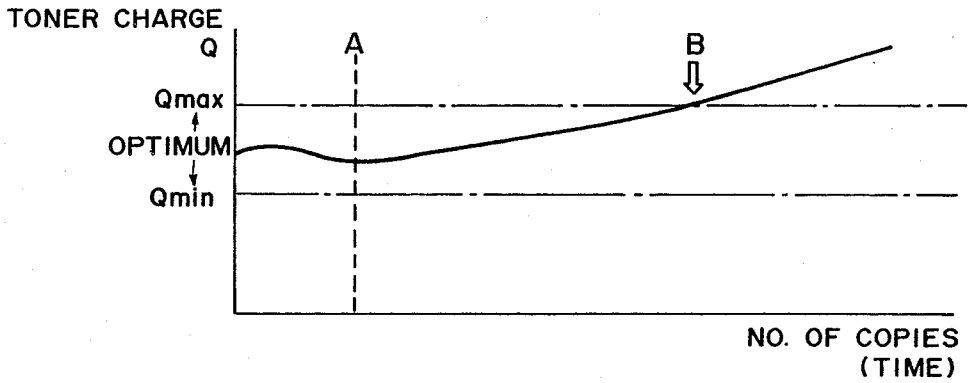
FIG. 8B is a graph showing a change of a charge amount of the toner in the state of FIG. 8A.

As shown in FIG. 8A, when the originals with which the toner consumption is very small are continuously copied from the point of time A, the toner content hardly changes, and therefore, the state of Vb>Vc continues, therefore, only the stirring operation is continued with the toner supply. When this occurs, the amount of charge of the toner increases gradually from the print of time A, as shown in FIG. 8B. At a certain point B, it exceeds the higher limit of the proper level Qmax. Therefore, the resultant images thereafter have low image density due to the toner charge-up, despite the fact that the toner content is proper.

Figure 5:
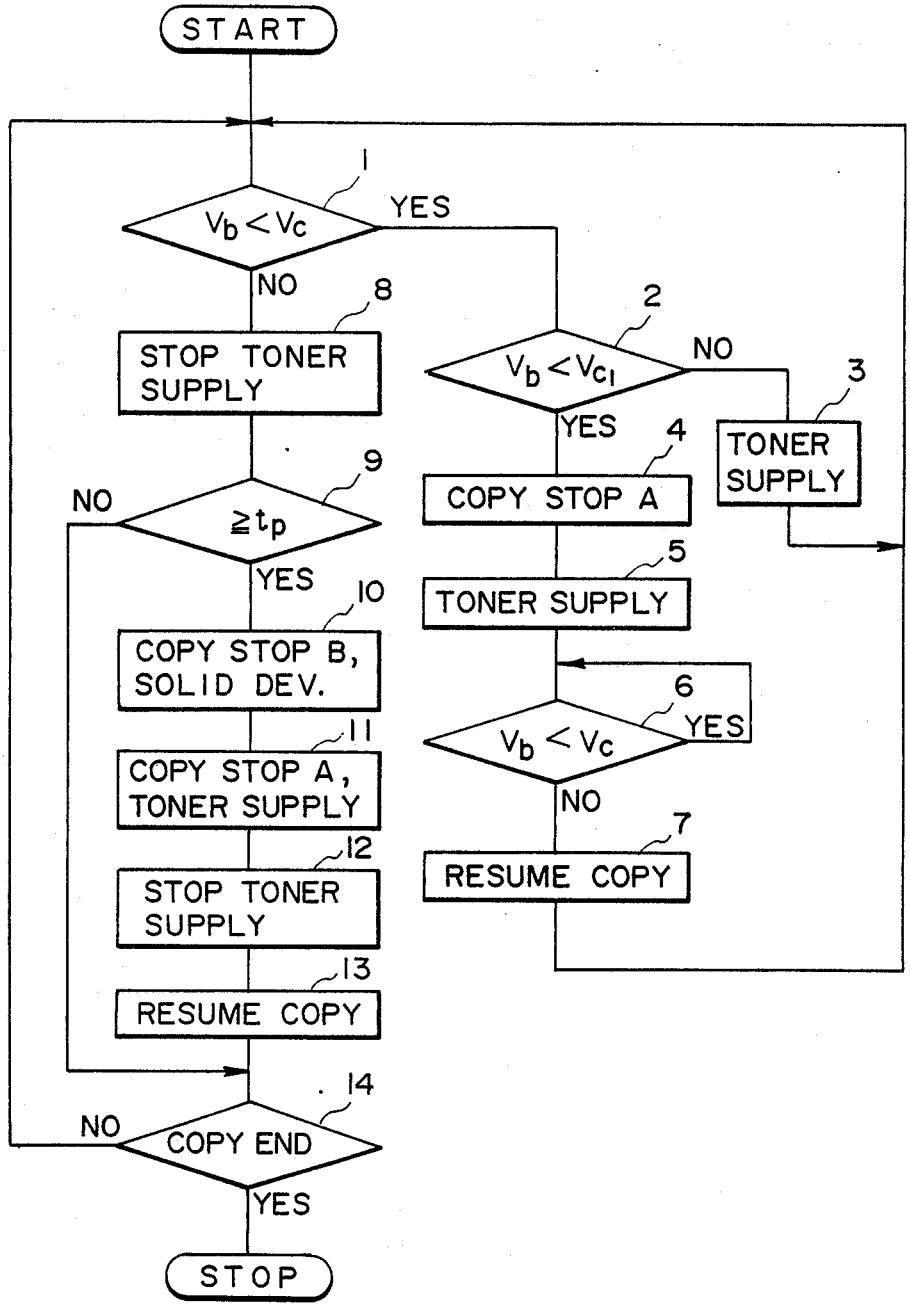
FIG. 5 is a flow chart illustrating the control.

To obviate this problem as shown in FIG. 5 (flow chart), when no toner supply signal engaging the clutch 21 is not produced within a predetermined period $t_p$ from stoppage of the previous toner supply, that is, when the condition of Vb>Vc is satisfied for the period of time longer than $t_p$, the CPU 25 supplies to the control circuit 27 an instruction signal for executing a copy interruption modes B, at step (10), upon which the control circuit 27 stops the image exposure of the drum 109 to image light through the optical system. The control circuit 27, in this mode B, operates the charger 111, the motor 19 of the developing device and the developing bias voltage 108, but deenergizes the discharging lamp 107. Therefore, a solid (black) latent image is formed on the drum 109, that is, a latent image capable of uniformly attracting the toner over substantially the entire length of the drum, is formed, so that the toner on the sleeve 1*a* over substantially the entire length thereof is consumed for developing the solid latent image. The circumferential length of the developed latent image on the drum preferably corresponds to at least one circumferential length of the sleeve 1*a*, since then the toner particles deposited on the sleeve with strong electrostatical force can be greatly removed from the entire surface of the sleeve 1*a*.

After the solid image development described above for developing a solid latent image is continued for a predetermined period of time, and then, the solid image development operation is stopped. Thereafter, the copy operation is resumed. Preferably, however, after the completion of the solid latent image development, new toner is supplied from the toner containing chamber D to the developer chamber C. To accomplish this, the CPU 25, at step 11, supplies to the control circuit A an instruction signal for executing the copy interruption mode A to engage the clutch 21. By this, the toner is supplied into the developer chamber C for a predetermined period of time, and the developer is stirred, so that the newly supplied toner is uniformly mixed with the entire developer in the toner chamber C. Thus, the charge level of the toner in the chamber C is generally reduced. After the continuance of the toner supply for a predetermined period of time, the CPU 25, at step 12, disengage the clutch 21, and resume the copy operation at step 13.

Figure 9A:
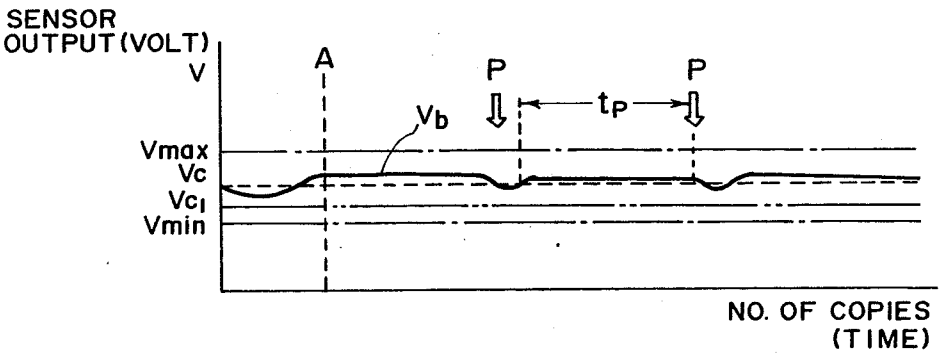
FIG. 9A is a graph showing the toner content change during image formation with small toner consumption in an embodiment of the present invention.

Accordingly, as shown in FIG. 9A even if the copy operation continues without supply of the new toner necessitated by toner consumption by the image recording, the copy operation is interrupted at the point of time P to intentionally consume a part of the toner by the solid latent image development, and new toner is supplied into the chamber C whereby the excessive charging of the toner can be prevented.

Figure 9B:
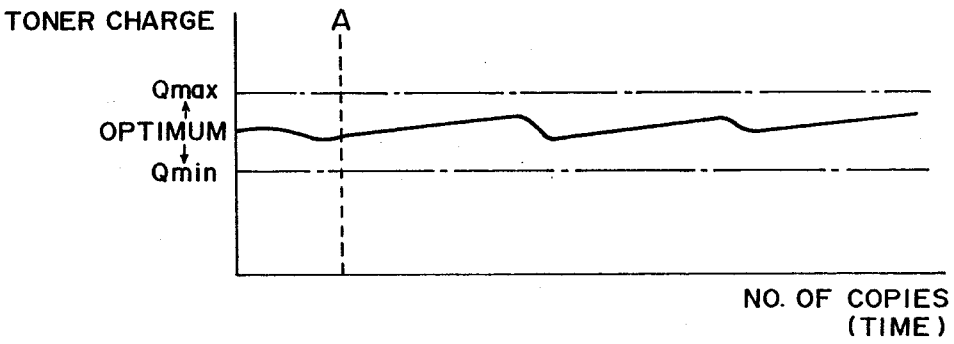
FIG. 9B is a graph showing the toner charge amount change in the state shown in FIG. 9A.

FIG. 9B shows the change of the toner charge when the above control is effected. As will be understood by the solid image development at the time P, the condition of Vb<VC is reached before the amount of toner charge exceeds Qmax, and new toner is supplied. Therefore, the amount of charge of the toner is always maintained in the proper range, that is, not less than Qmin and not more than Qmax, as shown in FIG. 9B.

In the foregoing embodiment, the solid image development is performed for a predetermined period of time which is sufficient to decrease the toner content down to lower than T0 (sensor output voltage of Vc), and thereafter the toner supply is performed for a predetermined period which is sufficient to a proper level of the toner content which is not more than T0 and more than Tmax (sensor output voltage of Vmax). Alternatively, however, the solid image development and the toner supply may be controlled while checking the output of the content sensor 12. In other words, the steps 10, 11 and 12 of FIG. 5 may be replaced with the flow chart of FIG. 10.

Figure 10:
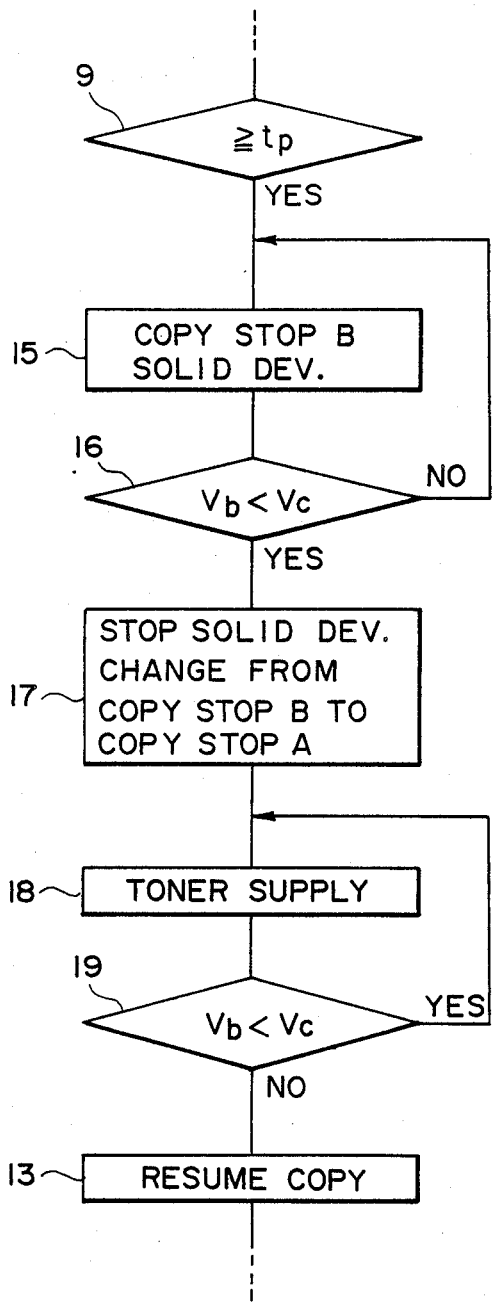
FIG. 10 is a partial flow chart illustrating the control.

In FIG. 10, the CPU 25, at step 15, instructs copy interruption instruction in mode B to the control circuit 27, by which the above-described solid image development is performed. Then, at step 16, the discrimination is made as to whether or not the sensor output voltage Vb becomes lower than the reference voltage Vc. If not, the solid image development is continued to consume the charged-up toner. When the voltage Vb becomes smaller than Vc, the CPU 25, at step 17, stops the solid image development, and instructs the control circuit 27 to switch from the copy interruption mode B to the copy interruption mode A. Then, the mode is changed to the one by which the toner is not deposited onto the photosensitive drum. The CPU 25 then engages the clutch 21, and at step 19, the toner is supplied from the toner chamber D to the developer chamber C while the developer is being stirred in the chamber C, until the sensor output voltage Vb becomes discriminated as being equal to or higher than the reference voltage Vc. By this, the newly supplied developer is uniformly stirred with the existing developer, and the average toner charge in the developer falls within the proper range.

Generally, the charging property of the toner changes with temperature and humidity. For example, some toner is such that under a high temperature and low humidity condition (condition I), the amount of charge of the toner is quickly increased; under a high temperature and high humidity condition (condition II), the amount of charge is large, but the increase is slow; and under a low temperature and low humidity condition (condition III), the toner is not excessively charged. When such toner is used, it is further preferable that the duration of the solid image development is changed in accordance with the temperature and the humidity.

In doing so, as shown in FIG. 4, the CPU 25 is given the information indicative of the temperature and the humidity. In FIG. 4, an output signal from a temperature sensor 28 is supplied to a comparator circuit 29 to compare it with a reference temperature, and the result of comparison is transmitted to the CPU 25. An output signal of a humidity sensor 28' is supplied to a comparator circuit 29' to compare it with a reference humidity, and the result of comparison is transmitted to the CPU 25. On the basis of the temperature and humidity information thus provided, the CPU 25, at step 20 of FIG. 11, discriminates as to in which of the conditions I, II and III the current ambient condition is. On the basis of the discrimination, the length of the solid image measured along the circumference of the drum (which corresponds to the length of time during which the solid image development is performed), is determined. The lengths of the solid images W1, W2 and W3 correspond to the conditions I, II and III, respectively, wherein W1>W2>W3.

If the toner has such a property as described hereinbefore in the condition III, W3 may be zero. The length of the solid image can be controlled by controlling the operation period of the charge 111 or controlling the turning-off time of the lamp 107 while continuing the operation of the charger 111.

In this embodiment, the time period of the solid image development at step 10 is changeable in accordance with the conditions I, II and III, and therefore, the deliberate toner consumption meets the amount of excessive charge of toner.

Alternatively, the developing bias voltage applied to the sleeve 1a may be changed at step 20 without changing the length of the solid image. In this case, the developing bias voltages B1, B2 and B3 correspond to the conditions I, II and III, respectively, whereby $|B1|<|B2|<|B3|$. Thus, the quantity of the toner deposited onto the solid latent image increases in the order of condition III, condition II and condition I. In this case, also, the toner consumption at step 10 meets the amount of excessive charge of the toner.

The lengths of the solid images and the developing bias voltages may not be stepwise, but may be continuously changed in accordance with the detected ambient conditions.

If the toner has such a property that the change in the amount of charge is small in response to the change of the humidity, or if the toner has such a property that the change in the amount of charge is small relative to the change in the temperature, the length of the solid image or the developing bias voltage level may be controlled only in response to the temperature change or only in response to the humidity change.

Figure 11:
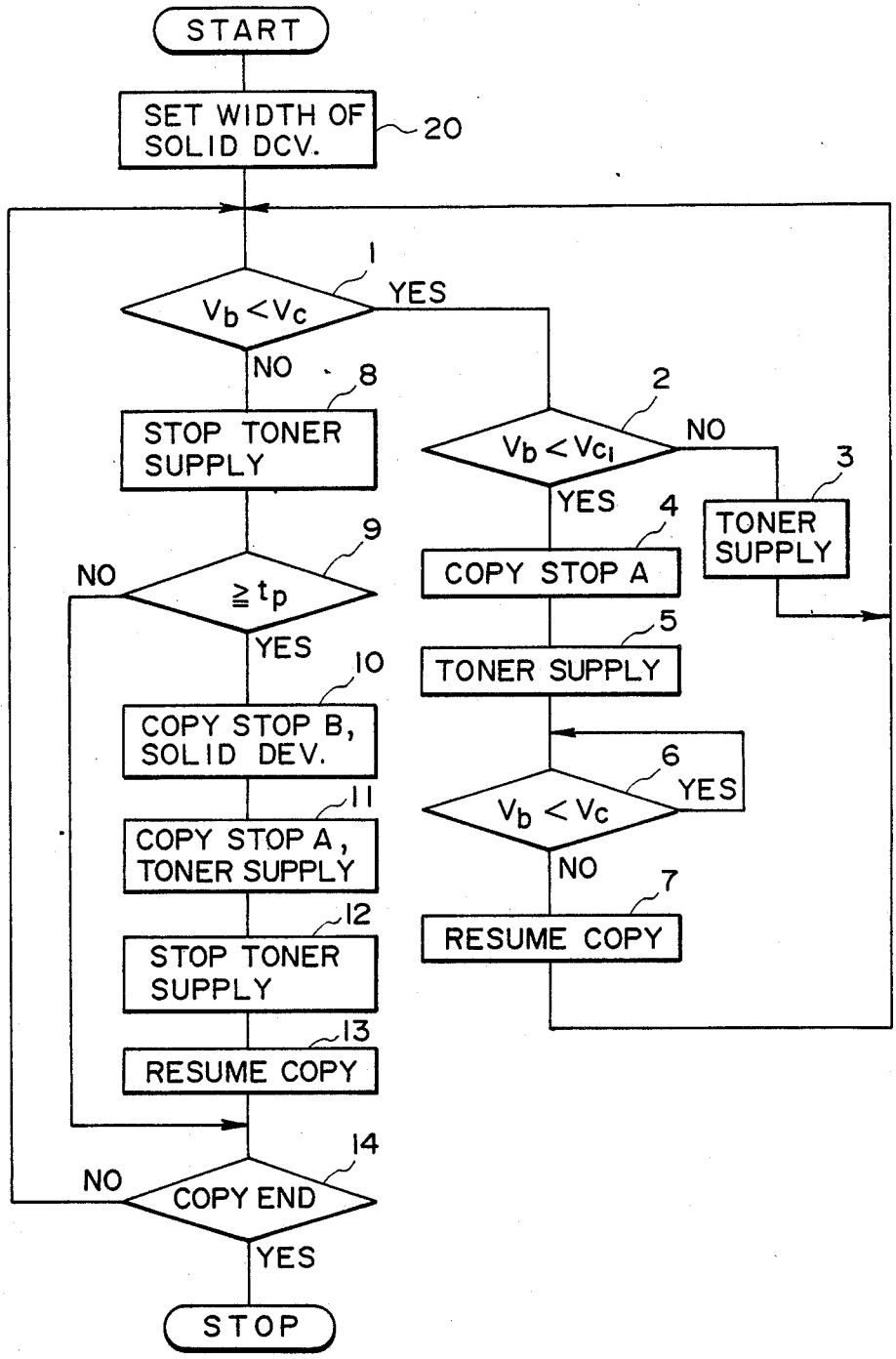
FIG. 11 is a flow chart of another example.

Also, in FIG. 11, the steps 10, 11 and 12 are replaceable with the steps 15, 16, 17, 18 and 19 of FIG. 10.

In FIGS. 5 and 11, the steps 1 and 6 discriminates whether Vb is smaller than Vc; the step 8 instructs the toner supply and stop; the step 14 discriminates whether or not the copy operation stops, that is, whether or not the preset number of images have been recorded; the step 2 discriminates whether or not Vb is smaller than Vc1; the steps 3 and 5 instruct toner supply; the step 4 instructs the copy interruption mode A; and the steps 7 and 13 instruct the copy operation resuming.

In any case, in the foregoing embodiment, the length of the solid latent image, the duration of consuming the excessively charged toner is properly determined on the basis of the charging property of the toner, structure of the developer stirring mechanism, volume of the developer chamber and/or the like.

The time $t_p$ described hereinbefore is normally between several seconds and several tens seconds. However, this is not inevitable but may be changed in accordance with the charging property of the toner, the structure of the developer stirring mechanism, the volume of the developer chamber and/or the like.

In the foregoing embodiments, the execution or non-execution of the solid image development is discriminated depending on whether or not the toner supply signal is produced within the predetermined period of time. However, it is a possible alternative that the number of produced toner supply signals, and the solid image development, and preferably, the toner supply are performed when the number counted within a predetermined period is smaller than a predetermined. In this case, the event that the toner supply signal is not produced within the predetermined period of time, corresponds to the event that the number counted is zero.

In the foregoing embodiments, the developed solid image is not transferred onto a transfer material, but is removed by the cleaning member 117. Alternatively, however, the solid developed image may be transferred onto the transfer sheet in order to reduce the burden of the cleaning member 117.

In the foregoing embodiments, the solid latent image is a uniformly solid image. However, the latent image for removing the excessively charged toner may be in the form of a periodical pattern of solid stripes each having a length of several tens mm measured along the circumference of the drum.

In the foregoing embodiment, the toner amount (content) detecting means is in the form of a photodetecting type. However, it may be of a volume detecting type, magnetic permeability detecting type, by electric constant detecting type or the like.

The present invention is applicable to a device wherein the second reference voltage Vc1 is not used, and the measured toner content is compared only with a single reference level, in response to this comparison, the toner supply is controlled.

Also, the present invention is applicable to an image forming apparatus wherein a photosensitive member is exposed to light from a laser source, light emitting diode or the like, modulated in accordance with the image to be recorded. In this type of image forming apparatus, a so-called reverse development system wherein the toner is deposited onto the light potential region of the photosensitive member is suitable.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image bearing member;

latent image forming means for forming a latent image on said image bearing member;

developing means for developing the latent image, including:

a developer container for containing a developer including carrier and toner particles;

a toner container for containing the toner particles;

toner supply means for supplying the toner particles from said toner container to said developer container;

a developer carrying member for carrying on its surface the developer supplied from said developer container;

a sensor for detecting a toner content in the developer, said apparatus further comprising:

control means for controlling the toner supply from said toner container to said developer container on the basis of an output of said sensor, wherein when a toner supply signal is not produced within a predetermined period of time, a predetermined latent image is formed on said image bearing member, and the predetermined latent image is developed by said developing means.

2. An apparatus according to claim 1, wherein said control means controls said toner supply means to supply the toner particles from said toner container into said developer container, in association with the development of the predetermined latent image.

3. An apparatus according to claim 1 or 2, wherein the predetermined latent image is a solid latent image.

4. An apparatus according to claim 1 or 2, wherein the predetermined latent image has a length, measured in a direction of movement of said image bearing member, which is larger than one full circumferential length of said developer carrying member.

5. An image forming apparatus, comprising:

an image bearing member;

latent image forming means for forming a latent image on said image bearing member;

developing means for developing the latent image, including:

a developer container for containing a developer including carrier and toner particles;

a toner container for containing the toner particles;

toner supply means for supplying the toner particles from said toner container to said developer container;

a developer carrying member for carrying on its surface the developer supplied from said developer container;

a sensor for detecting a toner content in the developer, said apparatus further comprising:

control means for controlling the toner supply from said toner container to said developer container on the basis of an output of said sensor, wherein when a toner supply signal is not produced within a predetermined period of time, a predetermined latent image is formed on said image bearing member, and the predetermined latent image is developed by said developing means, said control means controls a quantity of the toner particles consumed by the development of the predetermined latent image.

6. An apparatus according to claim 5, wherein said control means controls the quantity of the toner particles in accordance with a change of a factor influential to charge of the toner.

7. An apparatus according to claim 6, wherein said control means controls the quantity of the toner in accordance with at least one of ambient temperature and humidity.

8. An apparatus according to claim 6, wherein said control means controls a length of the predetermined latent image, measured along a movement detection of said image bearing member.

9. An apparatus according to claim 6, wherein said control means controls a developing bias voltage applied to said developer carrying member when the predetermined latent image is developed.

10. An apparatus according to any one of claims 5–9, wherein said control means controls said toner supply means to supply the toner particles from said toner container into said developer container, in association with the development of the predetermined latent image.

11. An apparatus according to claim 10, wherein the predetermined latent image is a solid latent image.

12. An apparatus according to claim 11, wherein the predetermined latent image has a length, measured in a direction of movement of said image bearing member, which is larger than one full circumferential length of said developer carrying member.

* * * * *